United States Patent [19]

Takenaka et al.

[11] Patent Number: 4,714,856

[45] Date of Patent: Dec. 22, 1987

[54] COLOR CATHODE RAY TUBE WITH PLURAL ELECTRON GUN ASSEMBLIES

[75] Inventors: Shigeo Takenaka; Eiji Kamohara; Takashi Nishimura, all of Fukaya, Japan

[73] Assignee: Kabushiki Kaisha Toshiba, Kawasaki, Japan

[21] Appl. No.: 858,002

[22] Filed: May 1, 1986

[30] Foreign Application Priority Data

May 10, 1985 [JP] Japan ..... 60-97901

[51] Int. Cl.[4] ..... H01J 29/07; H01J 29/50; H01J 29/82; H01J 29/86

[52] U.S. Cl. ..... 313/2.1; 313/402; 313/477 R; 220/2.1 A

[58] Field of Search ..... 313/477 R, 1, 2.1, 402, 313/408; 220/2.1 A, 2.3 A; 358/242

[56] References Cited

U.S. PATENT DOCUMENTS 3,071,706 1/1963 Waldorf ..... 313/477 R

FOREIGN PATENT DOCUMENTS 39-25641 9/1964 Japan .
42-4928 2/1967 Japan .
49-26029 7/1974 Japan .
54-12035 5/1979 Japan .

*Primary Examiner*—David K. Moore
*Assistant Examiner*—K. Wieder
*Attorney, Agent, or Firm*—Cushman, Darby & Cushman

[57] ABSTRACT

In a color cathode ray tube, a vacuum envelope is provided with a plurality of necks and a plurality of funnels for coupling the respective neck to a single panel. A plurality of electron gun assemblies are received in the neck, respectively and a plurality of deflection yokes are mounted around the funnels, respectively. A screen is formed on the inner surface of the faceplate of the panel and is defined by a plurality of continuous segment regions each of which is scanned with electron beams from the corresponding electron gun assembly and deflected by corresponding deflection yoke. A shadow mask is received in the panel and is faced to the screen. The shadow mask has a plurality of effective row and column regions corresponding to the segment regions and a noneffective region for surrounding and partitioning the respective segment regions.

6 Claims, 7 Drawing Figures

COLOR CATHODE RAY TUBE WITH PLURAL ELECTRON GUN ASSEMBLIES

BACKGROUND OF THE INVENTION

The present invention relates to a color cathode ray tube and, more particularly, to a color cathode ray tube of a multineck structure.

Color cathode ray tubes have received a great deal of attention as high-quality broadcast image display devices or computer terminal high-resolution graphic display devices. For these applications, increased resolution has been an issue. High resolution in a color cathode ray tube can be achieved by minimizing an electron beam spot on its phosphor screen. However, in order to minimize the electron beam spot, the electrode structure of the electron gun assembly must be improved, or the electron gun assembly itself must be elongated and enlarged to increase its diameter. However, a large electron gun assembly cannot provide a sufficiently small electron beam spot due to the following reason. The larger the size of the color cathode ray tube, the longer the distance between the electron gun assembly and the phosphor screen, giving the electron lens an undesirably large magnification. In order to achieve high resolution in a large cathode ray tube, it is important to decrease the distance between the electron gun assembly and the phosphor screen. For this purpose, the tube can be constituted by a wide-angle deflection tube. However, in such a tube, the magnification at the central portion of the screen differs from that at the peripheral portion thereof.

In order to solve the above problem, Japanese Patent Disclosure (Kokai) No. 48-90428 describes a multi-tube structure display device having a plurality of small or medium cathode ray tubes arranged in the horizontal or vertical direction to display an image on a large screen with high resolution.

A conventional display device of the multi-tube structure can be effectively used outdoors to display an image on a very large screen divided into blocks. However, the display device is not suitable for a medium screen size, i.e., about 40', since the joints of the divided blocks of the screen stand out and result in a poor image. In particular, when this display device is used as a computer-aided design graphic terminal, the presence of joints becomes a decisive shortcoming.

SUMMARY OF THE INVENTION

It is an object of the present invention to provide a large high-resolution color cathode ray tube.

In order to achieve the above object of the present invention, there is provided a color cathode ray tube comprising:

a vacuum envelope including a panel having a single faceplate, and a skirt extending from the faceplate, a plurality of funnels coupled to the panel, and a plurality of necks respectively extending from the plurality of funnels;

a plurality of electron gun assemblies respectively accommodated in the plurality of necks, each electron gun being emitting a plurality of electron beams;

a plurality of deflection units respectively mounted around the plurality of funnels, each deflection unit being adapted to deflect electron beams emitted from a corresponding one of the plurality of electron gun assemblies;

a screen formed on the faceplate, including phosphor elements for emitting light rays of different colors upon landing of electron beams, and defined by a plurality of continuous segment regions each of which is scanned with electron beams emitted from corresponding one of the plurality of electron gun assemblies and deflected by corresponding one of the plurality of deflection units; and mask means received in the vacuum envelope and faced to the faceplate and having a plurality of effective row and column regions corresponding to the plurality of segment regions and noneffective regions for surrounding and partitioning the effective row and column regions, the effective regions being provided with apertures for allowing passage of electron beams and land of the electron beams on the phosphor elements in the corresponding segment regions and the apertures being formed at predetermined pitches.

DETAILED DESCRIPTION OF THE PREFERRED EMBODIMENT

Figure 1:
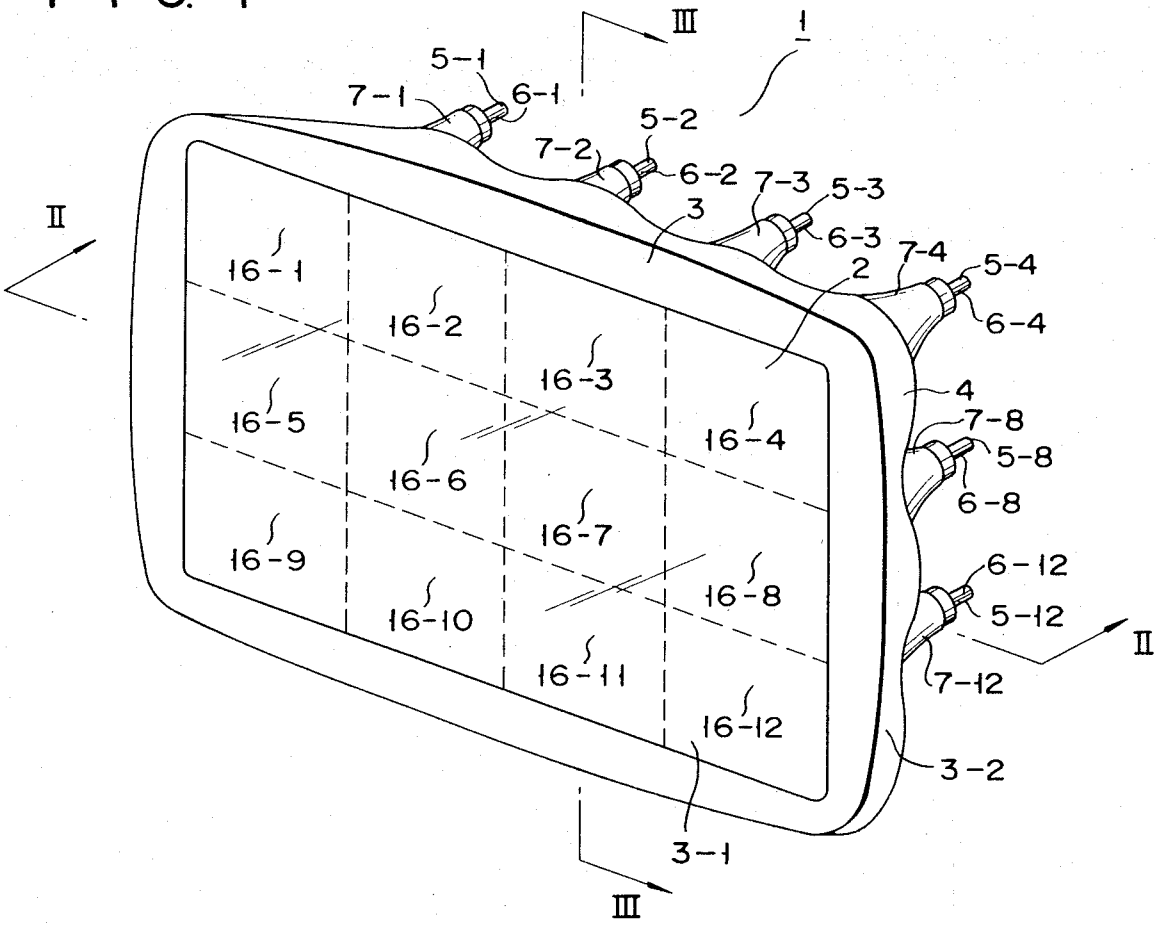
FIG. 1 is a perspective view of a color cathode ray tube having a multineck structure according to an embodiment of the present invention.
Figure 2:
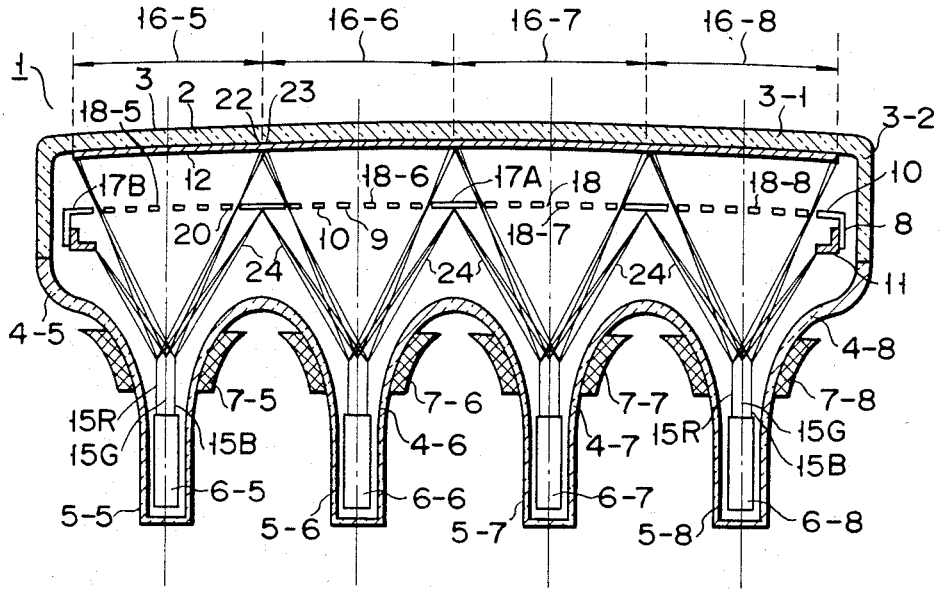
FIG. 2 is a sectional view of the color cathode ray tube in FIG. 1 taken along the line II—II thereof.
Figure 3:
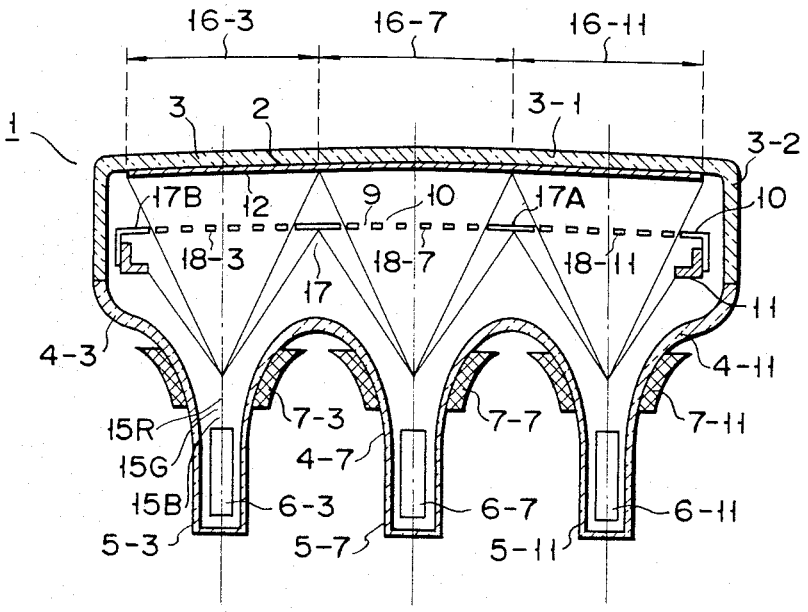
FIG. 3 is a sectional view of the color cathode ray tube in FIG. 1 taken along the line III—III thereof.

Referring to FIG. 1 to FIG. 3, there is illustrated color cathode ray tube 1 having a multineck structure according to an embodiment of the present invention. In tube 1, phosphor screen 2 is formed on the inner surface of faceplate 3-1 of panel 3. A plurality of necks 5-1, . . . 5-12 are hermetically coupled to skirt 3-2 of panel 3 extending along the edge of faceplate 3-1 through a plurality of funnels 4-1, . . . 4-12 to constitute a vacuum envelope. Screen 2 includes a large number of groups each consisting of red, green, and blue phosphor stripe layers 12. Layers 12 are covered with a metallized layer. Electron gun assemblies such as inline or delta type assemblies 6-1, . . . 6-12 each, having electron gun units, for emitting three different electron beams toward the screen are respectively accommodated in necks 5-1, . . . 5-12. A plurality of deflection yokes 7-1, . . . 7-12 are respectively mounted on the outer surfaces of funnels 4-1, . . . 4-12 to deflect the electron beams emitted from assemblies 6-1, . . . 6-12. Mask unit or structure 8 including shadow mask 10 located facing screen 2 and separated therefrom by a predetermined distance and having a plurality of apertures 9 and frame 11 for supporting mask 10, is mounted on the inner surface of skirt 3-1 of panel 3.

Three electron gun units in each of assemblies 6-1, . . . 6-12 respectively emit electron beams 15-R, 15-G, and 15-B in response to the corresponding video signal components. Beams 15-R, 15-G, and 15-B are deflected by corresponding yokes 7-1, . . . 7-12. Segment regions 16-1, . . . 16-12 of screen 2 which correspond to assemblies 6-1, . . . 6-12 are scanned with the respective sets of deflected beams 15-R, 15-G, and 15-B. Beams 15-R, 15-G, and 15-B are incident on mask 10 at predetermined angles and are selected according to the incident angles. Beams 15-R, 15-G, and 15-B then land on corresponding phosphor stripe layers 12 of the screen and cause emission thereof. Single screen 2 is defined as a set of regions 16-1, . . . 16-12 respectively corresponding to assemblies 6-1, . . . 6-12. As shown in FIGS. 1 to 3, three segment regions are aligned in the vertical direction and four segment regions are aligned in the horizontal direction to constitute a total of 12 segment regions 16-1, . . . 16-12 in a matrix form.

Noneffective region 17B without apertures 9 is formed around mask 10 in the same manner as in the conventional shadow mask color cathode ray tube. In addition, grating-like noneffective regions 17A without apertures are formed to partition screen 2 into effective regions 18-1, . . . 18-12 with apertures 9 corresponding to regions 16-1, . . . 16-12.

In the color cathode ray tube, three electron beams from each one of assemblies 6-1, . . . 6-12 are deflected in the vertical and horizontal directions. The electron beams deflected to overscanning ranges over a predetermined effective range are shielded by the noneffective regions 17A and 17B and do not land on screen 2 when the noneffective regions 17A and 17B are overscanned with the electron beams. However, the electron beams deflected within the predetermined effective scanning ranges along the vertical and horizontal directions pass through apertures 9 of regions 18-1, . . . 18-12 of mask 10 and land on predetermined phosphor stripe layers 12 of screen 2. In the above embodiment, assemblies 6-1, . . . 6-12 are sequentially energized to generate each set of three electron beams from assemblies 6-1, . . . 6-12. The four first rows, i.e., first horizontal segment regions of screen 2 are horizontally scanned with four sets of the three electron beams, respectively. Horizontal scanning is repeated along the vertical direction to display an image in the four first row segment regions of screen 2. Similarly, four second and third rows, i.e., second and third horizontal segment regions are scanned with the respective sets of three electron beams to display an entire image on screen 2.

It is apparent that twelve segment regions 16-1, . . . 16-12 may be simultaneously scanned with twelve sets of three electron beams to display an entire image on screen. In this display method, it is necessary that video signal is converted into segment video signals by a video processor (not shown) and the segment video signals are supplied to the electron gun assemblies and deflection yokes to display segment images constituting an entire image on the segment regions, respectively.

Rasters in the adjacent segment regions neither overlap each other at their boundary nor have a blank therebetween. The rasters continue smoothly. As is apparent from FIG. 2, showing the horizontal cross section of the color cathode ray tube, three electron beams 15-R, 15-B, and 15-G emitted from first electron gun assembly 6-5 at a given moment pass through outermost apertures 20 in region 18-1 of mask 10 and land on outermost stripe layers 22 within the first segment region in screen 2. Outermost layers 22 in the first segment region emit light rays. Subsequently, second electron gun assembly 6-6 is energized and emits three electron beams. These beams pass through outermost apertures 21 in second effective region 18-6 in mask 10. Stripe layers 23 in the second segment region of screen 2 emit light beams by the three electron beams emitted from assembly 6-6. All electron beams 24 deflected to the overscanning range are shielded by regions 17A and do not reach the screen. Therefore, the rasters are smoothly continuous on screen 2. As shown in FIG. 3, in the vertical segment regions, the rasters can be smoothly continued. The width of region 17A must be greater than the pitch of apertures 9 in regions 18-1, . . . 18-12.

In a color cathode ray tube with a shadow mask which has not improper noneffective regions, the size of each raster must be accurately controlled. Unless the rasters are formed upon scanning of each segment region of screen 2 with deflected electron beams, a nonemitting portion between the adjacent segment regions is formed. This effect is the same as in Japanese Patent Disclosure No. 48-90428 wherein a plurality of discrete cathode ray tubes are aligned. When each segment region is scanned with the overscanning electron beams to form rasters in the color cathode ray tube having a shadow mask with improper noneffective regions, the rasters overlap at the boundary between the adjacent segment regions. The overlapping portion is brighter than the other portions, thus resulting in poor image reproduction. In practice, it is difficult to maintain the raster at a certain predetermined size. In color cathode ray tubes, the effective segments of the screen are normally scanned with the overscanning electron beams.

As described above, according to the present invention, even if each segment region is scanned with the overscanning electron beams, the above-mentioned problems do not occur.

In the above embodiment, mask unit 8 includes mask 10 made of a single 0.2-mm thick iron plate with apertures 9 at predetermined positions and 1.5-mm thick frame 11 for supporting mask 10.

Figure 4:
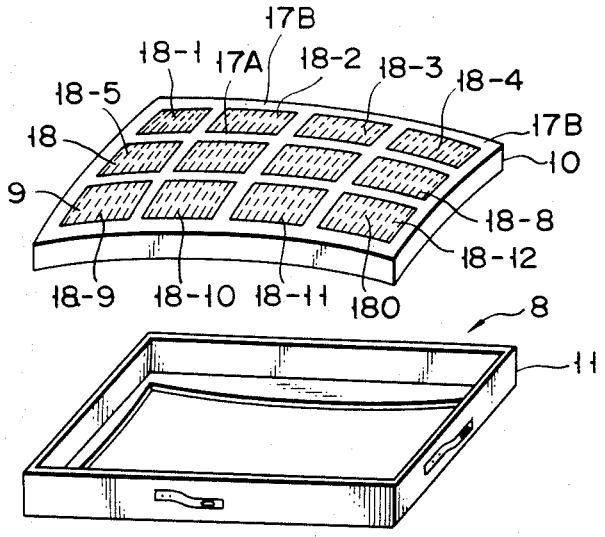
FIG. 4 is an exploded perspective view of a shadow mask structure shown in FIG. 2.

As shown in FIG. 4, effective regions 18 and noneffective regions 17A and 17B are continuously formed on a single iron plate.

Figure 5:
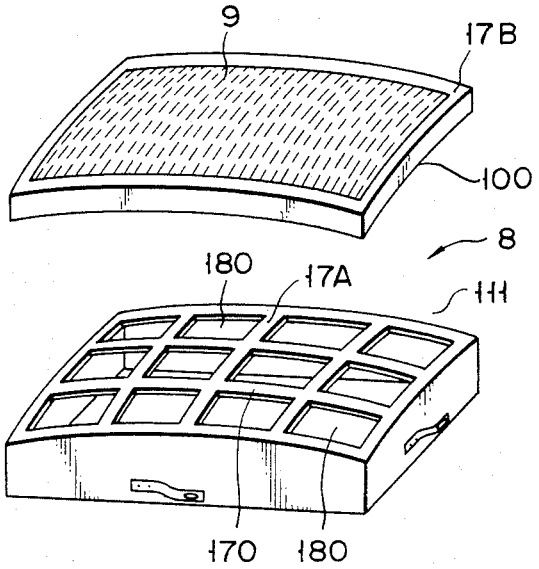
FIGS. 5 to 7 are exploded perspective views of modifications of shadow mask structures according to the present invention.

As shown in FIG. 5, however, single shadow mask 100 with apertures over the entire curved surface in the conventional color cathode ray tube may be bonded to shielding plate 111 for shielding the apertures of the predetermined positions to constitute mask unit 8.

Figure 6:
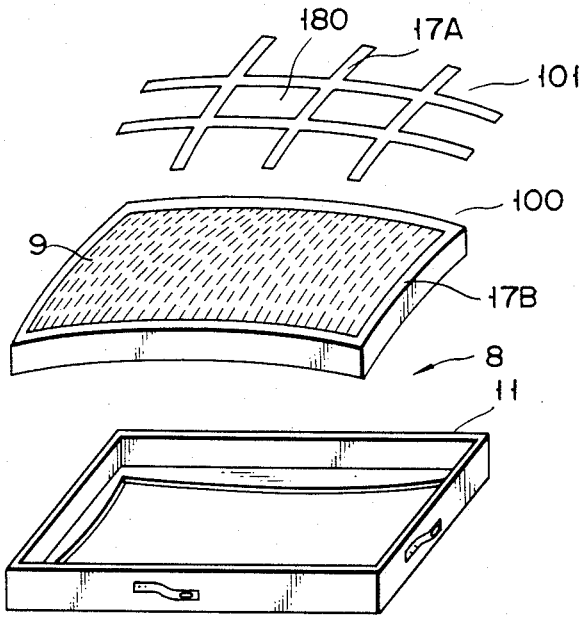

Grating-like frame 101 is bonded to the above-mentioned shadow mask 100 to constitute mask unit 8, as shown in FIG. 6. In this case, grating-like frame 101, thicker than mask 100, is formed to support mask 100 against vibrations and electron beam bombardment. In order to prevent thermal deformation caused by electron beam bombardment in the conventional color cathode ray tube, mask 100 is preferably made of an invar material having a low thermal conductivity rather than alumikilled steel. However, since invar has poor workability and low resistance to vibrations, it cannot be used in practical applications. However, if frame 111 in FIG. 6 is used, the large shadow mask can be divided into small regions and can be supported by the rigid frame. The problems posed by poor workability and low resistance to vibration can thus be solved. If alumikilled steel is used, thermal deformation caused by electron beam bombardment can be substantially prevented by use of the thick grating-like frame. In addition, by use of such a frame, the radius of curvature of the faceplate and hence the mask can be increased. It is preferable to flatten the faceplate and the screen surface to facilitate viewing of the screen. To do this, the shadow mask must also be flattened. The shadow mask loses self-holding properties and has low resistance to heat and electron beam bombardment, thus posing the practical problems. As described above, however, since the grating-like frame is used, the large shadow mask area can be divided into small regions and the edges of the respective regions can be firmly supported by the frame.

The detailed dimensional and other technical data of the arrangement of FIG. 6 will be summarized as follows:

Thickness of Mask 100: 0.15 mm

Size of Slit Aperture 9: 0.88 mm (vertical direction)×0.22 mm (horizontal direction)

Pitches of Apertures 9: 1.0 mm (vertical direction) and 0.75 mm (horizontal direction)

Thickness of Frame 111: 1.2 mm

Size of Mask 100 and Frame 111: about 300 mm (vertical direction(×400 mm (horizontal direction)

Number of Effective Regions: 3 rows×4 columns=12

One window 180, i.e., the effective region of frame 111, is defined as about 80 mm×80 mm. The grating portion, i.e., the noneffective region has a width of about 15 mm.

The width of the noneffective region depends on the number of effective regions and a deflection angle.

Figure 7:
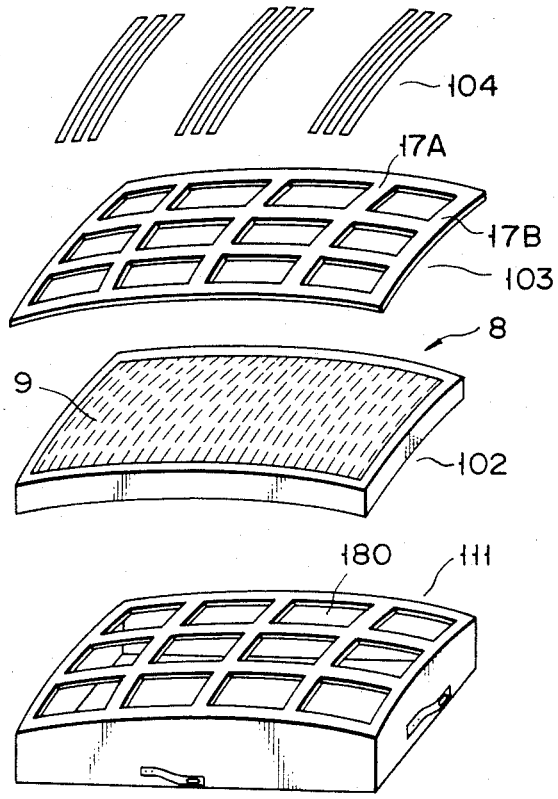

In the above embodiment, the cathode ray tube has one shadow mask. The present invention can also be applied to a focus mask tube having a plurality of masks, as described in Japanese Patent Disclosure No. 57-163955 and Japanese Patent Publication Nos. 55-24652 and 58-54457. The mask in the focus mask tube has low mechanical strength due to large electron beam apertures. Masks in Japanese Patent Disclosure No. 57-163955 attract each other by an electrical force generated by a difference between potentials applied to the plurality of masks and the resulting breakdown voltage characteristic problem prevent use of masks of equal area. The present invention is especially effective in such masks. FIG. 7 shows an arrangement as described above. Referring to FIG. 7, mask unit 8 comprises shadow mask 102 welded on grating-like frame 111. Mask 102 has a larger aperture size than that of the conventional color cathode-ray tube. Thin insulating grating 103 made of a polyimide film or the like is aligned with the grating-like frame portion of mask 102. Grill-like mask electrodes 104 are located on grating 103 and adhered thereto by an adhesive agent. Frame 111 and mask 102 are kept at the same potential, e.g., 25 kV, and electrodes 104 are kept at a slightly lower potential, e.g., 24 kV. The resultant cathode ray tube serves as a focus mask tube.

With this structure, the mask unit can be divided into small regions fixed by the grating and the frame. Therefore, the resultant tube can serve as a focus mask tube without posing any problems.

In the above description, each electron gun assembly is an inline type assembly. However, the present invention is not limited to such an assembly, but can also be applied to a delta type assembly.

As set out in a U.S. patent application (Ser. No. 853,763) relating to the Takenaka et al. invention which was filed on April 18, 1986 and assigned to the same assignee, a color CRT structure for permitting an electron beam which has been emitted from a single electron gun to be converted into a plurality of apparent electron beams after it is minutely deflected can also apply to the present invention.

In this connection it is to be noted that a plurality of electron beams appearing in the specification and claims of the present application covers such a plurality of apparent electron beams and that the term "electron gun assembly" appearing in the specification and claims of the present application also covers the aforementioned Tanaka et al. electron gun and auxiliary deflecting means.

In the above description, the phosphor screen is constituted by phosphor stripes. However, the phosphor screen may comprise circular phosphor patterns of a delta arrangement.

According to the present invention as described above, unlike in a divided display type color cathode ray tube, the boundaries of the divided regions are integrally combined by the common screen. The mask unit is divided into small effective and noneffective regions with and without apertures. Overscanning beams are shielded by the noneffective regions. Adjacent rasters do not overlap or have spaces therebetween, thus providing a high-quality color cathode ray tube. Although the color cathode ray tube has a large single screen, it has a plurality of electron gun assemblies and a small tube length, thus obtaining a small electro-optical magnification and hence a high-resolution high-quality image.

What is claimed is:

1. A color cathode ray tube comprising:

a vacuum envelope including a panel having a single faceplate and a skirt extending from said faceplate, a plurality of funnels coupled to said panel, and a plurality of necks respectively extending from said plurality of funnels;

a plurality of electron gun assemblies respectively accomodated in said plurality of necks, each electron gun emitting a plurality of electron beams;

a plurality of deflection units respectively mounted around said plurality of funnels, each deflection unit being arranged to deflect electron beams emitted from a corresponding one of said plurality of electron gun assemblies;

a screen formed on said faceplate, including phosphor elements for emitting rays of different colors in response to impinging electron beams, and defined by a plurality of continuous segment regions scanned with electron beams emitted from corresponding ones of said plurality of electron gun assemblies and deflected by corresponding ones of said plurality of deflection units; and a mask received in the vacuum envelope and facing said faceplate and having a plurality of effective row and column regions corresponding to said plurality of segment regions and non-effective regions for surrounding and partitioning said effective row and column regions, said effective regions being provided with apertures for allowing passage of electron beams therethrough to impinge on said phosphor elements in the corresponding segment regions and said apertures being formed at predetermined pitches.

2. A color cathode ray tube according to claim 1, wherein each of said noneffective regions has a width larger than the predetermined pitch of said apertures to prevent passage of an electron beam deflected by a corresponding one of said deflection units over a predetermined effective range wherein overscanning is thus prevented.

3. A color cathode ray tube according to claim 1, wherein said noneffective regions are formed with a grating shape so as to partition said effective regions.

4. A tube according to claim 1, wherein said mask comprises a conductive mask plate having said plurality of effective regions and said noneffective regions have a grating-like shape for partitioning said effective regions, and a mask frame for supporting said conductive mask plate.

5. A tube according to claim 1, wherein said mask comprises a mask plate, having a plurality of effective regions, and a mask frame, with grating-like bridge sections defining the noneffective regions on said mask plate so as to partition said plurality of effective regions.

6. A tube according to claim 1, wherein said mask comprises a plurality of mask plates, said mask plates being adapted to define said effective regions and said noneffective regions for partitioning said effective regions, and a mask frame for supporting said plurality of mask plates.

* * * * *